United States Patent [19]

Lilly, Jr. et al.

[11] Patent Number: 4,607,646

[45] Date of Patent: Aug. 26, 1986

[54] PROCESS FOR MODIFYING THE SMOKE FLAVOR CHARACTERISTICS OF TOBACCO

[75] Inventors: A. Clifton Lilly, Jr.; Henry B. Merritt; Cassandra D. Owens, all of Richmond, Va.

[73] Assignee: Philip Morris Incorporated, New York, N.Y.

[21] Appl. No.: 577,458

[22] Filed: Feb. 6, 1984

[51] Int. Cl.[4] ..... A24B 15/00

[52] U.S. Cl. ..... 131/309; 131/300; 131/902

[58] Field of Search ..... 131/300, 309, 902

[56] References Cited

U.S. PATENT DOCUMENTS

| | | | |
|---|---|---|---|
| 246,975 | 9/1881 | Philips | 131/309 |
| 2,136,485 | 11/1938 | Berka et al. | 131/6 |
| 3,483,874 | 12/1969 | Hind | 131/309 |
| 3,517,672 | 6/1970 | Michelson | 131/309 |
| 3,631,865 | 1/1972 | Michelson | 131/309 |
| 3,760,815 | 9/1973 | Deszyck | 131/140 C |
| 3,771,533 | 11/1973 | Armstrong et al. | 131/140 |

FOREIGN PATENT DOCUMENTS

| | | | |
|---|---|---|---|
| 54-52798 | 4/1979 | Japan | 131/309 |
| 55-127980 | 3/1980 | Japan | 131/309 |
| 293760 | 10/1928 | United Kingdom | 131/309 |

*Primary Examiner*—V. Millin
*Assistant Examiner*—Gregory Beaucage
*Attorney, Agent, or Firm*—G. Esler Inskeep; Arthur I. Palmer, Jr.; Mary E. Bak

[57] ABSTRACT

Burley tobacco when cured is sought after as a component of commercial cigarette blends. The inventors have found that, to avoid its less desirable features, one may replace Burley with cured bright tobacco which has been heated in the presence of ammonia at moderate temperature.

10 Claims, No Drawings

PROCESS FOR MODIFYING THE SMOKE FLAVOR CHARACTERISTICS OF TOBACCO

The present invention relates to a method for modifying the flavor characteristics of tobacco, in particular cured bright tobacco. Moreover, the present invention concerns modifying the smoking flavor characteristics of tobacco without the addition of ingredients extraneous to tobacco. This method employs ammonia as the primary agent.

BACKGROUND OF THE INVENTION

Ammonia treatment of tobacco has been employed in the past, principally as a means to displace and effect release of nicotine. Denicotinization processes have been described. Representative of such processes are those disclosed in U.S. Pat. Nos. 1,640,298 (Sartig), 1,719,291 (Federmann), 2,136,485 (Berka et al), 2,162,738 (McCoy), 2,227,863 (Rhodes) and 3,742,962 (Brochot). In some procedures, the temperature is elevated very little, in others at least to 100° C., but in every instance there is removal of components, notably nicotine, from the tobacco and generally speaking no effort is made to maintain the presence of ammonia without dilution (as by steam) or removal (as by sweeping with air or steam).

Ammonia was disclosed as an expansion agent for tobacco by Armstrong et al., U.S. Pat. No. 3,771,533. The process involves impregnation of tobacco with liquid or gaseous ammonia and exposure of the resulting tobacco to very rapid heating in unconfined (open vessel) conditions to bring about expansion with release of the ammonia. The reasons for a need for expanded tobacco are well known.

Deszyck, U.S. Pat. No. 3,760,815 discloses the use of ammonium salts of carboxylic acids, made alkaline with added ammonium hydroxide, to treat a slurry of tobacco parts to release pectins therefrom which will serve as a binder for reconstituted tobacco sheet prepared from the composite. The slurry may be heated during the pectin release step. The cast sheet is then dried with loss of the ammonia together with the excess water.

In all the prior disclosures such as those mentioned above, either the tobacco is not heated when it is maintained in contact with ammonia, or it is heated in circumstances which dictate either the rapid disappearance of ammonia or its considerable dilution, as with water or a gas (air, steam).

SUMMARY OF THE INVENTION

This invention concerns a method for altering the smoke flavor characteristics of tobacco or reconstituted tobacco, not by adding a flavorant per se, but by treating the tobacco in a novel manner. This treatment comprises heating cured tobacco, in particular bright tobacco, in the continuing presence of ammonia for a period of ½ to 24 hours at a temperature of 80° to 150° C. This is best done in a closed system, so that there will be no loss of volatiles suc as nicotine and certain flavor notes, nor loss of water which might necessitate reordering. The result of this treatment is to produce a bright tobacco which when blended has smoking qualities in many ways quite similar to those of similar blends containing Burley.

Definitions

As used herein, the following terms have the indicated meanings.

FILLING POWER

The ability of tobacco to form a firm cigarette rod at a given moisture content. A high filling power indicates that a lower weight of tobacco is required to produce a cigarette rod of a given circumference and length than is required with a tobacco of lower filling power. Filling power is increased by stiffening tobacco and also by expanding tobacco.

CYLINDER VOLUME (CV)

The volume that a given weight of shredded tobacco occupies under a definite pressure. The CV value is expressed as cc/10 g. To determine this value, tobacco filler weighing 10.000 g is placed in a 3.358 cm diameter cylinder, vibrated for 30 seconds on a "Syntron" vibrator, and compressed by a 1875 g piston, 3.33 cm in a diameter for five minutes; the resulting volume of filler is reported as cylinder volume. This test is carried out at standard environmental conditions of 23.9° C. and 60% relative humidity (RH). A high Cylinder Volume indicates a high Filling Power.

OVEN-VOLATILES CONTENT (OV)

A unit indicating the moisture content (or percentage of moisture) in tobacco filler. It is determined by weighing a sample of tobacco filler before and after exposure in a circulating air oven for three hours at 100° C. The weight loss as a percentage of initial weight is the oven-volatiles in addition to water but OV is used interchangeably with moisture content and may be considered equivalent thereto since, at the test conditions, not more than about 1% of the tobacco filler weight is volatiles other than water.

EQUILIBRIUM OVEN-VOLATILES CONTENT ($OV_{eq.}$)

The OV value determined after the tobacco filler has been equilibrated by conditioning at 23.9° C. and 60% RH for 18 hours.

DETAILED DESCRIPTION OF THE INVENTION

Burley tobacco when cured and cut as filler produces a cigarette which most smokers find unacceptably choking, with harshness at the back of the throat. Nevertheless, Burley has come to be a necessary component of many commercial blends for cigarette making. Its use in moderation adds certain desirable flavor notes and effects to the overall perception of the smoke that is not obtainable from the other usual components of the tobacco blends (bright and Oriental tobaccos). Burley filler unfortunately contributes to the smoke a disproportionately large amount of nitrogen oxides, components which are considered among the less desirable ones. This contribution is diminished to some extent if the leaf is washed to remove nitrates, but for reasons of economy and flavor loss this approach leaves something to be desired.

It has been discovered, quite unexpectedly, that flue-cured bright tobacco heated in a closed vessel in the presence of ammonia becomes quite Burley-like in its flavor contribution to the smoke stream, but there is no concomitant increase in the delivery of nitrogen oxides. The ammonia may be introduced as liquid ammonia or as a concentrated aqueous solution (28%) but is preferably introduced in gaseous form. The vessel containing the tobacco may be first partially or severely evacuated, but this is not essential. Ammonia is introduced into the vessel or the tobacco is treated with ammonia before being introduced, so that its vapors contact the tobacco during subsequent heating. The vessel is then heated, or heat is applied to the tobacco within the vessel, to bring its temperature to 80° to 150° C. This temperature preferably is maintained for 30 minutes to 24 hours. During the holding time, the vessel is preferably kept closed, but if necessary, the pressure may be limited to some predetermined level by opening a relief valve and closing it as required to maintain the desired pressure.

The OV of the tobacco preceding the treatment is not critical. It may range from about 3% to as high as 20% as may be present in tobacco in equilibrium with water-saturated air at room temperature.

It will be evident that with a closed system and a high initial moisture content, the product will need to be dried to usual OV levels ("making moisture") for use in smoking product blends; in other situations wherein there is release of pressure or a low initial moisture content, a reordering or rehumidifying of the product may be called for. The product after treatment usually requires exposure to circulating air to permit escape of excess ammonia; this exposure may be adequate to bring the moisture content to usual equilibrium levels for processing into smoking products.

The concentration of ammonia needed to accomplish the objective of the invention will vary somewhat with the other parameters: temperature and time of treatment, use of a closed or pressure-controlled system, and the like. The concentration is best expressed in terms of measurable parameters of the system, such as partial vapor pressure of ammonia before heating, relative weights of tobacco (dry basis) and ammonia introduced, or concentration of aqueous ammonia whose vapors are in contact with the tobacco during the impregnation stage. The preferred concentration of $NH_3$ is approximately 3% by weight of the tobacco or 4 5 ml of $NH_4OH$/30 ml of $H_2O$ to 300 g of DBC bright tobacco.

EXAMPLE 1

Three 300-g portions of cut, flue-cured bright tobacco (uncased) were exposed to aqueous ammonia and held in separate desiccators for six days. The ammonia solutions, present in excess, were prepared from concentrated aqueous ammonia (28%) and water in ratios of 30 mL:30 mL, 45 mL:30 mL, and 60 mL:30 mL. A part of each tobacco batch was then placed in a closed jar and heated 24 hours in a 93° C. oven, then kept unopened for an additional 24 hours. Both heated and unheated filler was equilibrated at standard conditions of 24° C./60% RH before measurement of OV and CV (Table I). Cigarettes were made from the various products and controls, including a bright and a Burley control, unheated. Expert smokers concluded that the heated sample with 30:30 ammonia still exhibited many characteristics of bright tobacco; that the 45:30 sample was very close to Burley in flavor; and that the 60:30 sample was too strong with ammonia.

TABLE I

| Treatment | Equilibrated OV % | CV, cc/10 g |
|---|---|---|
| Control | 27.64 | 37.0 |
| Control, heated | 9.47 | 48.1 |
| 30:30 | 12.66 | 37.9 |
| 30:30, heated | 10.92 | 42.1 |
| 45:30 | 12.38 | 38.5 |
| 45:30, heated | 11.44 | 40.8 |
| 60:30 | 10.78 | 39.0 |
| 60:30, heated | 11.28 | 38.5 |

EXAMPLE 2

In a vessel equipped for loading with baskets containing batches of tobacco as strip and for heating with recirculated air as a closed or an open system, 70 pound batches of flue-cured bright strip were placed and were impregnated with gaseous ammonia to an uptake of 3% by weight during a one-hour hold. The initial heat-up to 111° C. required 15 minutes after which the temperature was maintained for 165 minutes with the system closed. The contents were held without heating for 1 hour, removed and bagged in polyethylene for 24 hours, and equilibrated 24 hours in air circulating at 24° C./60% RH. For comparison, a similar run was made without ammonia.

Analytical data are listed in Table II for samples from four locations (baskets) in the treating vessel, separated vertically (1=top to 4=bottom). Table III gives other measurements and machine smoking data from cigarettes made from these fillers.

TABLE II

| Analytical Data (Dry Weight Basis) | | | | |
|---|---|---|---|---|
| Baskets | 1 (Top) | 2 | 3 | 4 (bottom) |
| Run 14 - Control | | | | |
| Total N % | 2.76 | 2.84 | 2.68 | 2.65 |
| Total Alk. % | 3.17 | 3.18 | 3.14 | 3.03 |
| Red. Sug. % | 8.2 | 9.0 | 9.4 | 9.3 |
| $NH_3$ % | <0.1 | <0.1 | <0.1 | <0.1 |
| Run 14 - Heat Treated in a Closed System | | | | |
| Total N. % | 2.97 | 2.80 | 2.84 | 2.77 |
| Total Alk. % | 3.74 | 3.71 | 2.93 | 3.04 |
| Red. Sug. % | 5.3 | 5.2 | 4.0 | 3.3 |
| $NH_3$ % | <0.1 | <0.1 | <0.1 | <0.1 |
| Run 16 - Control | | | | |
| Total N % | 2.70 | 2.90 | 2.87 | 2.80 |
| Total Alk. % | 3.08 | 3.34 | 3.22 | 3.16 |
| Red. Sug. % | 7.7 | 8.2 | 6.7 | 6.9 |
| $NH_3$ % | <0.1 | <0.1 | <0.1 | <0.1 |
| Run 16 - Ammonia Impregnation with Heat Treatment in a Closed System | | | | |
| Total N % | 5.29 | 5.29 | 5.05 | 5.36 |
| Total Alk. % | 3.19 | 3.17 | 2.65 | 3.76 |
| Red. Sug. % | <2.0 | <2.0 | <2.0 | <2.0 |
| $NH_3$ % | 1.13 | 1.18 | 1.14 | 1.15 |
| Run 17 - Control | | | | |
| Total N % | 2.96 | 3.01 | 2.66 | 2.98 |
| Total Alk. % | 3.44 | 3.38 | 3.36 | 3.35 |
| Red. Sug. % | 7.8 | 6.9 | 9.1 | 9.1 |
| $NH_3$ % | <0.1 | <0.1 | <0.1 | <0.1 |
| Run 17 - Ammonia Impregnation with Heat Treatment in an Open System | | | | |
| Total N % | 4.95 | 4.61 | 4.79 | 4.74 |
| Total Alk. % | 3.65 | 3.03 | 3.59 | 2.66 |
| Red. Sug. % | <2.0 | <2.0 | <2.0 | <2.0 |
| $NH_3$ % | 1.10 | 1.17 | 1.11 | 1.03 |

| | Eq. CV cc/10 g | Eq. OV % |
|---|---|---|
| Control | 28.8 | 12.36 |
| Run 14 | 31.9 | 11.4 |
| Run 16 | 29.2 | 12.51 |
| Run 17 | 31.85 | 15.51 |

TABLE III

| | Smoking Results | | | | | | |
|---|---|---|---|---|---|---|---|
| | FTC mg/cigt | TPM mg/cigt | Nic. mg/cigt | $H_2O$ mg/cigt | Puff/ cigt. | RTD mm of Hg | Tob Wt g/cigt |
| Bright Control | 21.6 | 27.1 | 2.26 | 3.27 | 13.6 | 117 | 0.947 |
| Burley Control | 17.4 | 22.1 | 1.76 | 2.89 | 12.1 | 119 | 0.945 |
| Blended Control | 15.9 | 20.1 | 1.54 | 2.69 | 9.9 | 114 | 0.820 |
| Bright & Stem Control | 16.6 | 20.8 | 1.63 | 2.53 | 9.2 | 109 | 0.765 |
| Run 14 Uncased | 20.2 | 25.2 | 2.78 | 2.20 | 12.8 | 107 | 0.939 |
| Run 14 Cased | 20.8 | 26.1 | 2.28 | 3.04 | 12.5 | 119 | 0.898 |
| Run 16 Uncased | 21.4 | 26.9 | 2.33 | 3.13 | 13.8 | 114 | 0.912 |
| Run 16 Cased | 22.4 | 27.7 | 2.08 | 3.35 | 14.2 | 114 | 0.937 |
| Run 17 Uncased | 21.7 | 27.3 | 2.43 | 3.16 | 13.6 | 109 | 0.907 |
| Run 17 Cased | 22.4 | 27.4 | 2.06 | 2.94 | 13.8 | 112 | 0.912 |
| | Blend: 50% Bright Untreated Cased 20% Expanded Stem 30% Treated Bright (Uncased and Cased) | | | | | | |
| Run 14 Blend Uncased | 15.7 | 19.6 | 1.53 | 2.33 | 9.5 | 112 | 0.791 |
| Run 14 Blend Cased | 16.1 | 20.1 | 1.52 | 2.50 | 9.4 | 114 | 0.792 |
| Run 16 Blend Uncased | 15.3 | 19.2 | 1.49 | 2.43 | 9.5 | 112 | 0.779 |
| Run 16 Blend Cased | 15.6 | 19.6 | 1.52 | 2.49 | 9.7 | 112 | 0.797 |
| Run 17 Blend Uncased | 15.7 | 19.7 | 1.51 | 2.49 | 9.5 | 104 | 0.776 |
| Run 17 Blend Cased | 15.8 | 19.8 | 1.43 | 2.53 | 9.2 | 109 | 0.773 |

EXAMPLE 3

Cigarettes prepared from the products of Example 2, such as were smoked for Table III, were evaluated by a subjective smoking panel. Descriptive terms were applied by the expert smokers.

The following tabulation shows terms applied by two or more smokers, as well as terms by one smoker that would be expected for a Burley cigarette.

TABLE IV

| Subjective Panel Smoking | | | | |
|---|---|---|---|---|
| | | Bright control, cased | | Run 14 uncased |
| Two or more smokers | | bright<br>smooth<br>sweet<br>throat grab | peppery<br>burnt<br>straw<br>impact | bright<br>impact<br>phenolic |
| | Run 16 uncased | Run 16 cased | Run 16 blend uncased | Run 16 blend cased |
| Two or more Smokers | dirty<br>burnt<br>barnyard<br>cigar-like<br>ammonia<br>protein | cigar-like<br>mouth-coating<br>smooth<br>bitter<br>musty | dry<br>harsh<br>cigar-like | tinny<br>blended<br>burley<br>peppery<br>earthy |
| Only one Smoker | chocolate<br>bitter | dry<br>impact | hot<br>dirty | throat grab<br>bodied |

TABLE IV-continued

| Subjective Panel Smoking | | | |
|---|---|---|---|
| impact<br>dry<br>scratchy | dark<br>ammonia | chocolate | dry<br>cigar-like |

*underline indicates Burley descriptor.

The leaning toward Burley character of the product (Run 16) treated according to the invention is evident.

We claim:

1. A method for modifying the smoke flavor characteristics or non-burley tobacco to impart thereto burley-like smoke flavor characteristics, comprising the steps of:

a. contacting the non-burley tobacco with ammonia in a pressure-controlled system to provide sufficient pressure to maintan the continuing presence of ammonia; and b. reacting said ammonia with natural sugars in said tobacco by heating said tobacco and ammonia to a temperature of between about 80° C. to about 150° C. to impart burley-like smoke flavor characteristics to said tobacco and retain therein substantially all volatile tobacco components.

2. The method according to claim 1, wherein said pressure controlled system is a closed system.

3. The method according to claim 1, characterized in that said volatile components are selected from the group consisting of water, nicotine and ammonia.

4. The method according to claim 3, characterized that said maintaining step allows the retention of at least 90% by weight of the nicotine content of said untreated tobacco.

5. The method according to claim 1, characterized in that said ammonia is in an aqueous solution comprising between 30 milliliters and 60 milliliters $NH_4OH$ in 30 milliliters water for every 300 grams of tobacco.

6. The method according to claim 5, characterized in that said solution comprises about 45 milliliters $NH_2OH$ in 30 milliliters water for every 300 grams of tobacco.

7. The method according to claim 1 characterized in that said ammonia is introduced as a gas.

8. The method according to claim 1, characterized in that the quantity of ammonia contacting said tobacco represents about 3% by weight of said tobacco.

9. The method according to claim 1, characterized in that said conditions comprise an effective duration of treatment in a range of about 30 minutes to about 24 hours.

10. The method according to claim 1, characterized in that said tobacco is bright tobacco.

* * * * *

UNITED STATES PATENT AND TRADEMARK OFFICE

CERTIFICATE OF CORRECTION

PATENT NO. : 4,607,646

DATED : August 26, 1986

INVENTOR(S) : Lilly et al.

It is certified that error appears in the above-identified patent and that said Letters Patent is hereby corrected as shown below:

Col. 1, line 62, "suc" should be --such--

Col. 6, line 54, "or" should be --of--

Signed and Sealed this

Tenth Day of February, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,607,646

DATED : August 26, 1986

INVENTOR(S) : A. Clifton Lilly, Jr. et al.

It is certified that error appears in the above-identified patent and that said Letters Patent is hereby corrected as shown below:

Column 3, line 41, "4 5" should be -- 45 --.

Signed and Sealed this

Eighteenth Day of August, 1987

*Attest:*

DONALD J. QUIGG

*Attesting Officer*

*Commissioner of Patents and Trademarks*